United States Patent [19]

Dechenne et al.

[11] 4,231,483

[45] Nov. 4, 1980

[54] HOLLOW ARTICLE MADE OF AN ORIENTED THERMOPLASTIC

[75] Inventors: Roger Dechenne, Strombeek-Bever; Guy Hubert, Lasne-Chapelle-Saint-Lambert, both of Belgium

[73] Assignee: Solvay & Cie., Brussels, Belgium

[21] Appl. No.: 956,429

[22] Filed: Oct. 31, 1978

[30] Foreign Application Priority Data

Nov. 10, 1977 [FR] France ..... 77 34381

[51] Int. Cl.[3] ..... B65D 6/38; B65D 23/00

[52] U.S. Cl. ..... 220/66; 215/1 C

[58] Field of Search ..... 220/66, 70, 72, 74; 215/1 C

[56] References Cited

U.S. PATENT DOCUMENTS

| | | | |
|---|---|---|---|
| 3,511,401 | 5/1970 | Lachner | 215/1 C |
| 3,643,829 | 2/1972 | Lachner | 215/1 C |
| 3,718,229 | 2/1972 | Wyeth et al. | 251/1 C |
| 3,720,339 | 3/1973 | Khetani | 215/1 C |
| 3,870,181 | 3/1975 | Sincock | 215/1 C |
| 3,881,621 | 5/1975 | Adomaitis | 215/1 C |
| 3,917,095 | 11/1975 | Seefluth | 215/1 C |
| 3,934,743 | 1/1976 | McChesney et al. | 215/1 C |
| 4,108,324 | 8/1978 | Krishnakumar et al. | 215/1 C |

FOREIGN PATENT DOCUMENTS

| | | |
|---|---|---|
| 523182 | 7/1972 | Switzerland . |
| 380564 | 9/1974 | Switzerland . |

*Primary Examiner*—Steven M. Pollar
*Attorney, Agent, or Firm*—Spencer & Kaye

[57] ABSTRACT

A hollow article made of an oriented thermoplastic having improved resistance to lateral impact, and provided with a base composed, successively, of a peripheral arched profile, a substantially plane annular zone and a recessed central part in the shape of a dome, the diameter of the central part being less than 40% of the maximum diameter of the hollow article. Such a hollow article is particularly suitable for the packaging of beverages.

7 Claims, 3 Drawing Figures

HOLLOW ARTICLE MADE OF AN ORIENTED THERMOPLASTIC

BACKGROUND OF THE INVENTION

The present invention relates to a hollow article made of an oriented thermoplastic, having a generally cylindrical body and a reentrant base, and particularly a bottle or similar container.

At the present time, the use of thermoplastics for the production of hollow articles, such as bottles for the packaging of liquids, is becoming increasingly widespread.

In order to increase the mechanical strength of these hollow articles, they are more and more frequently blow-molded under such conditions, especially such temperature conditions, as lead to orientation, preferably biaxial orientation in two mutually perpendicular directions of the macromolecules of the material of which the articles consist.

In order to increase the stability of these hollow articles in an upright position, it is known to provide them with a recessed, or reentrant, base because this type of base has good resistance to deformation, especially under the influence of internal pressure.

However, hollow articles with such a recessed base have an impact strength, especially at their base, which often leaves something to be desired. In particular, these hollow articles do not have good resistance to lateral impacts, which they may suffer if they are dropped accidentally or especially when they are transported by rail.

SUMMARY OF THE INVENTION

It is an object of the present invention to improve the deformation resistance and lateral impact resistance of such hollow articles.

The objects of the invention are achieved by employing a novel shape, discovered after numerous experiments, for the recessed base of hollow articles of generally cylindrical shape, made from an oriented thermoplastic, which makes it possible to achieve, at one and the same time, good resistance to deformation and good resistance to lateral impact.

The present invention thus relates to a hollow article which consists of an oriented thermoplastic and possesses a neck zone, a side wall of generally cylindrical shape, and a recessed base, in which article the base consists successively, starting from the periphery, of a peripheral arched profile providing the connection to the side wall, a substantially planar annular zone joining onto the peripheral arched profile, and a central part in the form of a recessed dome which is connected to the annular zone and the diameter of which is less than 40% of the maximum external diameter of the hollow article.

The magnitude of the diameter of the central part in the shape of a recessed dome has been found to be a critical parameter. In fact, it has been found that the hollow article does not exhibit improved resistance to lateral impact if that diameter exceeds 40% of the maximum external diameter. Furthermore, if this diameter is less than 10% of the maximum external diameter of the hollow article, the molding of this central part presents delicate problems, especially in the production of hollow articles of small volume. Preferably, the diameter of the central part is between 15 and 30% of the maximum diameter of the hollow article.

According to a first embodiment of the invention, the peripheral arched profile of the base has a constant radius of curvature and is joined tangentially to the side wall and to the adjoining annular zone. In this case, the radius of curvature is preferably between 10 and 25% of the maximum diameter of the hollow article.

According to a second embodiment, which is preferred, the peripheral arched profile has two different constant radii of curvature. In this case, the first radius of curvature corresponds to the part of the profile which connects to the side wall and is greater than the second radius of curvature which corresponds to the part of the profile which connects to the annular zone of the base. These two successive radii of curvature are preferably chosen so that the cross-section of the arched profile does not have a point of inflection and so that it connects tangentially to the side wall on one side and to the annular zone of the base of the other side. The magnitude of the first radius of curvature is preferably between 50 and 200% of the maximum diameter of the hollow article and the magnitude of the second radius of curvature is preferably between 10 and 25% of the said maximum diameter.

The annular zone with which the base of the hollow article is provided contributes to improving the resistance of the hollow article to lateral impact. This zone can be essentially perfectly planar. It can also be slightly arched, preferably towards the interior of the hollow article. in this latter case, the radius of curvature of the annular zone is generally greater than the maximum external diameter of the hollow article. According to a preferred embodiment, the annular zone is inclined relative to the longitudinal axis of the hollow article so that when the latter stands on its base, it rests on the peripheral arched profile and the inner edge of the annular zone is located at a higher level than its outer edge. In this case, the annular zone has the form of a truncated cone. Preferably, the annular zone then forms an angle of between 1° and 15° with a plane perpendicular to the longitudinal axis of the hollow article. The annular zone can advantageously be utilized for providing inscriptions, in relief, which for example show the contents of the hollow article, the tradename of its manufacturer, a trademark, or a warning notice. The radial width of the annular zone is in general between 10 and 70% of the maximum diameter of the hollow article and preferably between 15 and 40% of this diameter.

The recessed central part in the shape of a dome can have various general shapes. However, according to a preferred embodiment, this central part consists, successively, of an arched zone which connects with the annular zone, an intermediate zone in the shape of a truncated cone, and a central cap pointing towards the interior of the hollow article and connecting to the truncated cone zone. The angle at the apex of the cone from which the truncated cone zone derives is in general between 15° and 90° and preferably between 30° and 75°.

The hollow article according to the invention has a side wall of generally cylindrical shape. However, this wall need not necessarily exhibit perfect symmetry of revolution, or axial symmetry. It is possible for the shape of this side wall to depart from that of a perfect cylinder. Thus, the hollow article can have an elliptical or polygonal cross-section. In these cases, it is preferred that the maximum dimension of the cross-section at right angles to the axis of the hollow article should not exceed twice the minimum dimension.

The hollow article according to the invention can be produced from any thermoplastic which can undergo molecular orientation. By way of non-limiting examples of these materials, there may be mentioned resins based on vinyl chloride, polymers and copolymers produced from alpha-olefines containing up to 8 carbon atoms in their molecule, acrylic polymers and copolymers, and especially those produced from acrylonitrile, as well as polyesters such as polyethylene glycol terephthalate, and polycarbonates. The hollow article can be produced by any of the known techniques which result in the production of molecularly oriented hollow articles and especially by known blow-molding or injection-blowing techniques.

DESCRIPTION OF THE PREFERRED EMBODIMENTS

Figure 1:
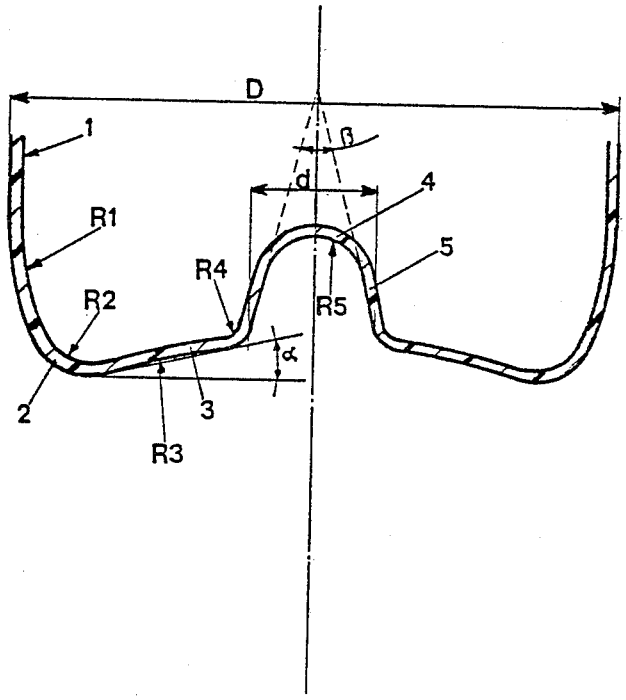
FIG. 1 is a cross-sectional, elevational view of the base region of a hollow article according to a preferred embodiment of the invention.

As shown in FIG. 1, the base of the hollow article 1 consists, successively, of a peripheral arched profile 2 providing the connection to the side wall of the hollow article, a substantially planar annular zone 3 connecting to the peripheral arched profile 2, and a recessed central part 4 in the shape of a dome connected to the inner edge of the annular zone, the maximum interior diameter d of this central part 4 being about 25% of the maximum external diameter D of the hollow article 1.

The peripheral arched profile 2 is formed with two successive radii of curvature, the first radius of curvature $R_1$ being 100 mm and being greater than the second radius of curvature $R_2$, which is 12 mm.

The annular zone 3 has the general shape of a shallow truncated cone and is slightly arched towards the interior of the hollow article 1, with a radius of curvature $R_3$ equal to 150 mm. Furthermore, this annular zone is inclined relative to the longitudinal axis of the hollow article 1 so that the angle $\alpha$ between the general inclination of the annular zone and a plane at right angles to the longitudinal axis of the hollow article 1 is 10°. The recessed central part 4 consists, successively, of an arched bottom zone of radius of curvature $R_4$ equal to 7 mm, providing the connection to the annular zone 3, a zone 5 in the shape of a truncated cone, of which the angle at the apex, $\beta$, of the projection of the walls of zone 5 is 30°, and a central cap of radius of curvature $R_5$ equal to 9 mm.

This hollow article according to the invention is particularly suitable for the packaging of non-carbonated table water and of carbonated beverages such as beer and soft drinks.

Figure 2:
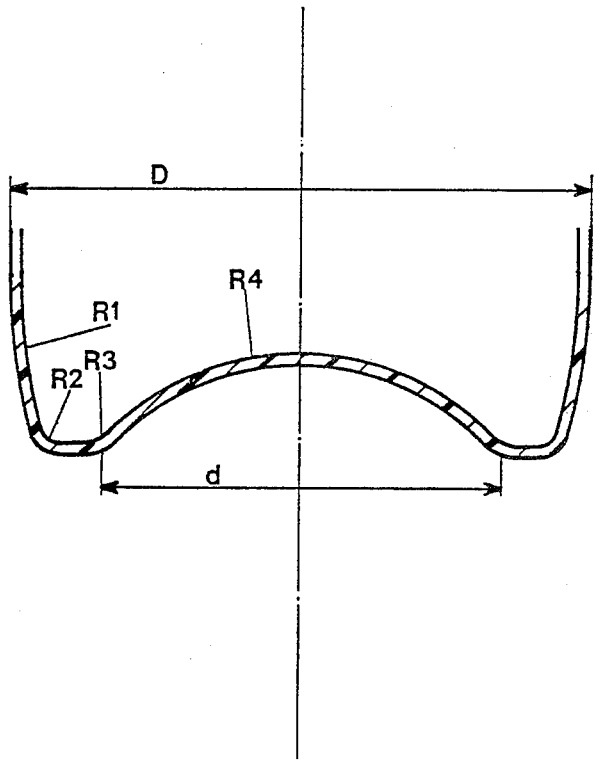
FIGS. 2 and 3 are views similar to that of FIG. 1 of the base regions of conventional hollow articles.
Figure 3:
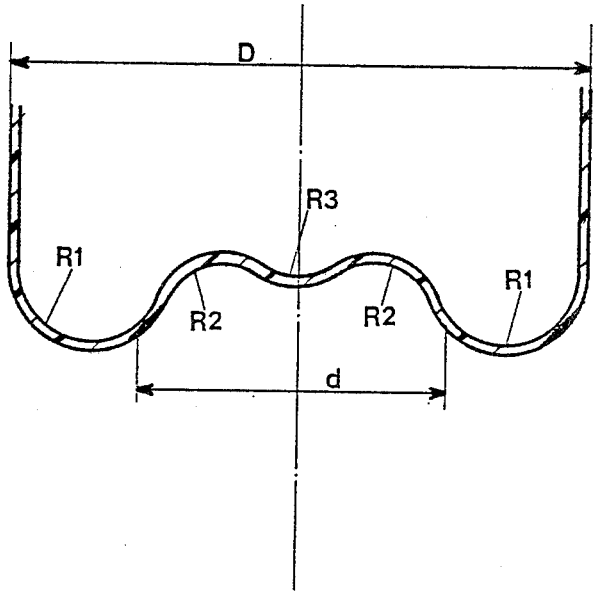

In order to show more clearly the advantages offered by hollow articles according to the invention, three series of molecularly oriented bottles of 1,500 cc capacity were produced, the bottles being provided with a base according to FIG. 1 or with conventional bases such as are shown in cross-section in FIGS. 2 and 3 of the attached drawings.

The thermoplastic employed is rigid polyvinyl chloride. The process conditions, in particular the parameters which determine the molecular orientation, are the smae for all three series of bottles.

The principal measurements of the bases of the hollow articles produced according to FIGS. 1 to 3 are as follows:

| | |
|---|---|
| Figure 1 | |
| D : 88.7 mm | $R_4$ : 7 mm |
| $R_1$ : 100 mm | $R_5$ : 9 mm |
| $R_2$ : 12 mm | d : 30 mm |
| $R_3$ : 150 mm | $\alpha$ : 10° |
| | $\beta$ : 30° |
| Figure 2 | |
| D : 89 mm | $R_4$ : 45 mm |
| $R_1$ : 60 mm | d : 65 mm |
| $R_2$ : 5 mm | |
| $R_3$ : 7 mm | |
| Figure 3 | |
| $R_1$ : 13 mm | D : 89 mm |
| $R_2$ : 10 mm | d : 50 mm |
| $R_3$ : 10 mm | |

The base shown in FIG. 2 consists, successively, of an arched peripheral profile having two different successive radii of curvature, a planar annular zone and a recessed central part in the shape of a dome, the diameter of which is greater than 40% of the maximum diameter of the bottle.

The base shown in FIG. 3 consists of three successive profiles each of constant radius and does not include any substantially planar annular zone.

The series of bottles thus obtained was then filled and closed identically, after which they were subjected, at 15° C., to the two impact strength tests described below.

In a first test, the filled bottles, starting from the horizontal position, were allowed to fall onto a concrete base, the drop heights of 0.7 m and 1.10 m being employed. This test made it possible to judge the strength of the bottles if they should fall accidentally from a table or from a display shelf.

In the second test, each bottle was attached to the end of a pendulum and struck a vertical concrete wall with a potential energy of 1.5 kgm. This test made it possible to judge the strength of the bottles in case of accidental knocks such as, for example, those caused during coupling of the railway cars in which the bottles are being transported to their points of distribution.

The results recorded during these tests are shown in Table I below. The numbers shown opposite the two types of tests give the number of bottles broken out of 100 bottles subjected to the test.

TABLE I

| TEST | BASE ACCORDING TO | | |
|---|---|---|---|
| | Figure 1 | Figure 2 | Figure 3 |
| 1st test, height 0.70 m | 0 | 10 | 15 |
| height 1.10 m | 20 | 40 | 60 |
| 2nd test | 30 | 65 | 65 |

It will be seen immediately that the hollow articles according to the invention, as shown in FIG. 1, exhibit markedly improved resistance to dropping and to lateral impact, compared to the other hollow articles, shown in FIGS. 2 and 3.

It will be understood that the above description of the present invention is susceptible to various modifications, changes and adaptations, and the same are intended to be comprehended within the meaning and range of equivalents of the appended claims.

What is claimed is:

1. In a hollow article made of a molecularly oriented thermoplastic and comprising a neck zone, a side wall of generally cylindrical shape, and a reentrant base, the improvement wherein said base consists, successively, starting from the periphery of said article, of a periphery arched profile connected to said side wall, a substantially planar annular zone joining onto said peripheral arched profile, which annular zone is in the shape of a truncated cone which forms an angle of between 1° and 15° with a plane at right angles to the longitudinal axis of said hollow article, with the inner edge of said annular zone being at a higher level than its outer edge, and a central part in the form of a recessed dome which is connected to said annular zone and the diameter of which is less than 40% of the maximum external diameter of said hollow article, said central part in the form of a recessed dome consisting, successively, of an arched zone which provides the connection with said annular zone, a zone in the shape of a truncated cone, and a central cap pointing towards the interior of said hollow article, and connecting with said truncated cone zone.

2. An article as defined in claim 1 wherein the diameter of the central part of said recessed dome is between 15 and 30% of the maximum external diameter of said hollow article.

3. An article as defined in claims 1 or 2 wherein said peripheral arched profile has a constant radius of curvature.

4. An article as defined in claims 1 or 2 wherein said peripheral arched profile has two different constant radii of curvature, of which the first, which corresponds to the part of said profile which connects to said side wall, is greater than the second, which corresponds to the part of said profile which connects to said annular zone.

5. An article as defined in claims 1 or 2 wherein said annular zone is arched towards the interior of said hollow article.

6. An article as defined in claims 1 or 2 wherein said annular zone is inclined relative to the longitudinal axis of said hollow article such that when the latter stands on its base, it rests on said peripheral arched profile.

7. An article as defined in claim 1 or 2 wherein the angle at the apex of the cone from which said truncated cone of said recessed dome is derived is between 15° and 90°.

* * * * *